US010677108B1

(12) United States Patent
Camilo et al.

(10) Patent No.: US 10,677,108 B1
(45) Date of Patent: Jun. 9, 2020

(54) TARGET WHEEL WITH A BAYONET TAB AND A REINFORCING GROOVE AND METHOD THEREOF

(71) Applicant: Schaeffler Technologies AG & Co. KG, Herzogenaurach (DE)

(72) Inventors: Alexandre Camilo, Rochester Hills, MI (US); Renato de Oliveira Ghiraldi, Madison Heights, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/357,636

(22) Filed: Mar. 19, 2019

(51) Int. Cl.
*F01L 1/34* (2006.01)
*F01L 1/344* (2006.01)

(52) U.S. Cl.
CPC ..... *F01L 1/344* (2013.01)

(58) Field of Classification Search
CPC . F01L 1/3442; F01L 1/46; F01L 1/344; F01L 2001/3445; F01L 2001/34483; F01L 2013/111; F01L 2820/041
See application file for complete search history.

(56) References Cited

U.S. PATENT DOCUMENTS 6,609,498 B2 8/2003 Mathews et al.
7,305,949 B2 12/2007 McCarthy et al.
2009/0017920 A1* 1/2009 Fox ..... F01L 1/3442 464/1

* cited by examiner

*Primary Examiner* — Zelalem Eshete

(57) ABSTRACT

A camshaft phaser, including: a first surface facing in a first axial direction; and a connection portion extending from the first surface in the first axial direction. The connection portion includes a wall with a second surface facing in a second axial direction, a first circumferentially disposed wall connected to the wall, a second circumferentially disposed wall connected to the wall, a first tab directly connected to the first circumferentially disposed wall and the second circumferentially disposed wall and extending radially outwardly past the first circumferentially disposed wall and the second circumferentially disposed wall, and a plurality of connected groove walls extending from the second surface into the wall in the first axial direction and bounding a reinforcing groove in the wall. At least a portion of the plurality of connected groove walls is located between the first circumferentially disposed wall and the second circumferentially disposed wall.

20 Claims, 12 Drawing Sheets

TARGET WHEEL WITH A BAYONET TAB AND A REINFORCING GROOVE AND METHOD THEREOF

TECHNICAL FIELD

The present disclosure relates to target wheel with a bayonet tab and a reinforcing groove, in particular, a reinforcing groove strengthening the bayonet tab. The present disclosure also relates to a method of fabricating a target wheel with a bayonet tab and a reinforcing groove. The present disclosure further relates to a camshaft phaser including a target wheel with a bayonet tab and a reinforcing groove.

BACKGROUND

A known camshaft phaser includes a position sensor target wheel connected by tabs to a spring for the camshaft phaser. The position sensor is used to detect a rotational position of the camshaft to enable proper phasing of the camshaft. During assembly of the camshaft phaser, a spring of the camshaft phaser rotates the tabs of the position sensor target wheel into contact with the rotor. The tabs can be damaged by the contact or by rough handling after installation of the spring, resulting in timing problems in the target wheel, which impacts the sensor's ability to properly read the camshaft position.

SUMMARY

According to aspects illustrated herein, there is provided a camshaft phaser, including: a first surface facing in a first axial direction, parallel to an axis of rotation of the target wheel; and a connection portion extending from the first surface in the first axial direction. The connection portion includes a wall with a second surface facing in a second axial direction opposite the first axial direction, a first circumferentially disposed wall connected to the wall, a second circumferentially disposed wall connected to the wall, a first tab directly connected to the first circumferentially disposed wall and the second circumferentially disposed wall and extending radially outwardly past the first circumferentially disposed wall and the second circumferentially disposed wall, and a plurality of connected groove walls extending from the second surface into the wall in the first axial direction and bounding a groove in the wall. At least a portion of the plurality of connected groove walls is located between the first circumferentially disposed wall and the second circumferentially disposed wall.

According to aspects illustrated herein, there is provided a method of fabricating a target wheel for a camshaft phaser, including: forming a first wall of the target wheel; extending a connection portion from the first wall in a first axial direction, the connection portion including a second wall with a first surface facing in a second axial direction opposite the first axial direction, a first circumferentially disposed wall connected to the second wall, a second circumferentially disposed wall connected to the second wall, and a tab directly connected to the first circumferentially disposed wall and the second circumferentially disposed wall and extending radially outwardly past the first circumferentially disposed wall; forming an indentation in the first surface; displacing material forming the second wall radially outwardly from the indentation; bounding the indentation with a plurality of connected groove walls in the second wall; locating the plurality of connected groove walls and the tab in sequence in a radially outward direction; and locating the plurality of connected groove walls between the first circumferentially disposed wall and the second circumferentially disposed wall.

According to aspects illustrated herein, there is provided a camshaft phaser, including: a stator arranged to receive rotational torque and including a plurality of radially inwardly extending protrusions; a rotor including a first wall, an indentation wall bounding an indentation in the first wall, and a plurality of radially outwardly extending protrusions circumferentially interleaved with the plurality of radially inwardly extending protrusions; a plurality of phaser chambers, each phaser chamber circumferentially bounded by a respective radially inwardly extending protrusion included in the plurality of radially inwardly extending protrusions and a respective radially outwardly extending protrusion included in the plurality of radially outwardly extending protrusions; and a target wheel including a first surface facing in a first axial direction, parallel to an axis of rotation of the target wheel, and a connection portion extending from the first surface in the first axial direction. The connection portion includes a wall with a second surface facing in a second axial direction opposite the first axial direction, a first circumferentially disposed wall connected to the second surface, a second circumferentially disposed wall connected to the second surface, a tab directly connected to the first circumferentially disposed wall and the second circumferentially disposed wall and extending radially outwardly past the first circumferentially disposed wall, and a plurality of connected groove walls. The plurality of connected groove walls extend from the second surface into the wall in the first axial direction and bound a reinforcing groove in the wall. At least a portion of the plurality of connected groove walls is located between the first circumferentially disposed wall and the second circumferentially disposed wall. At least a portion of the tab is located in the indentation of the rotor. The target wheel is arranged to detect a circumferential position of the rotor for use in rotating the rotor, with respect to the stator, to change a phase of a camshaft connected to the rotor.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1:
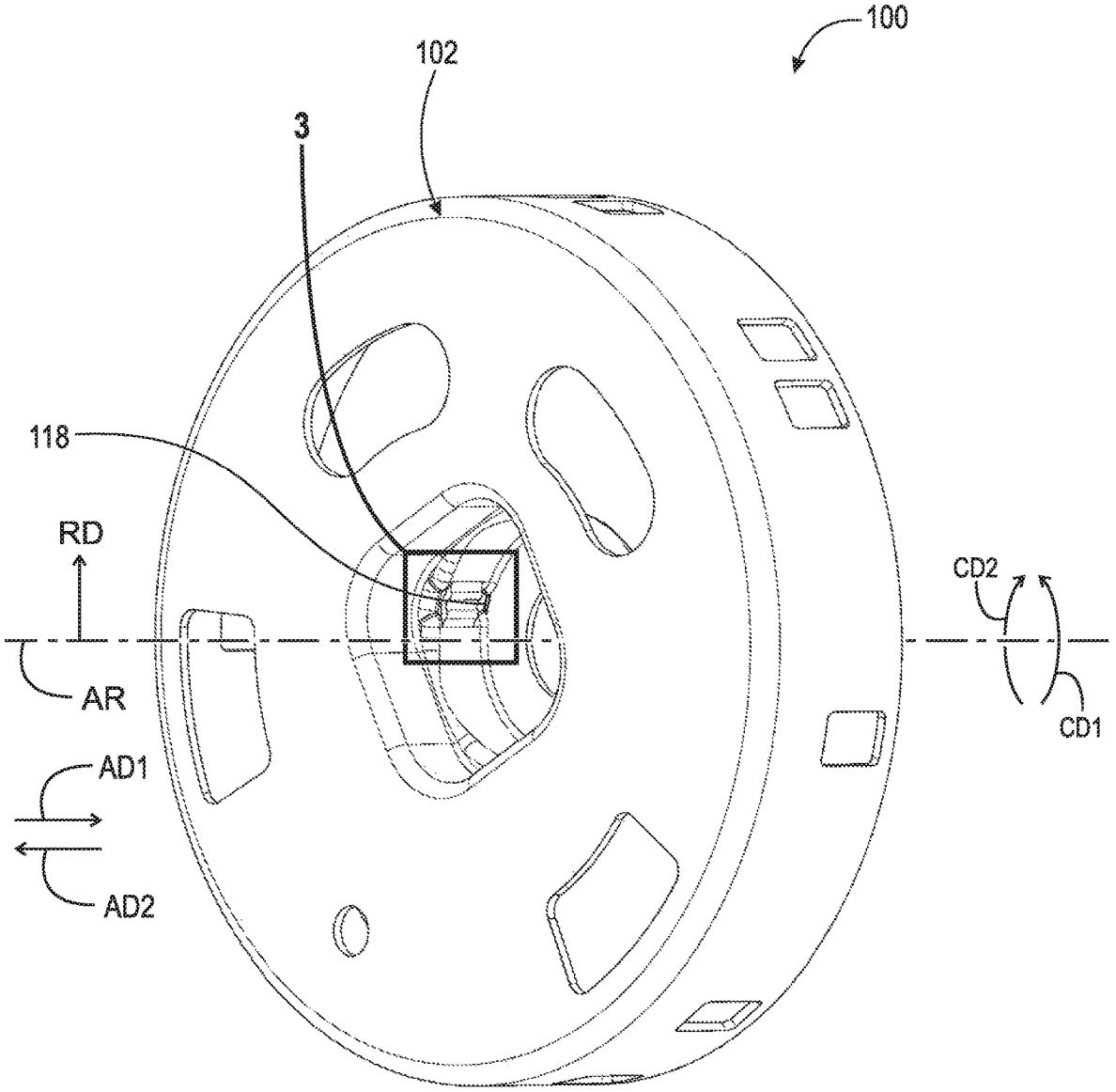
FIG. 1 is a back isometric view of a target wheel with a bayonet tab including a reinforcing groove.

FIG. 1 is a back isometric view of target wheel 100 with a bayonet tab including a reinforcing groove.

Figure 2:
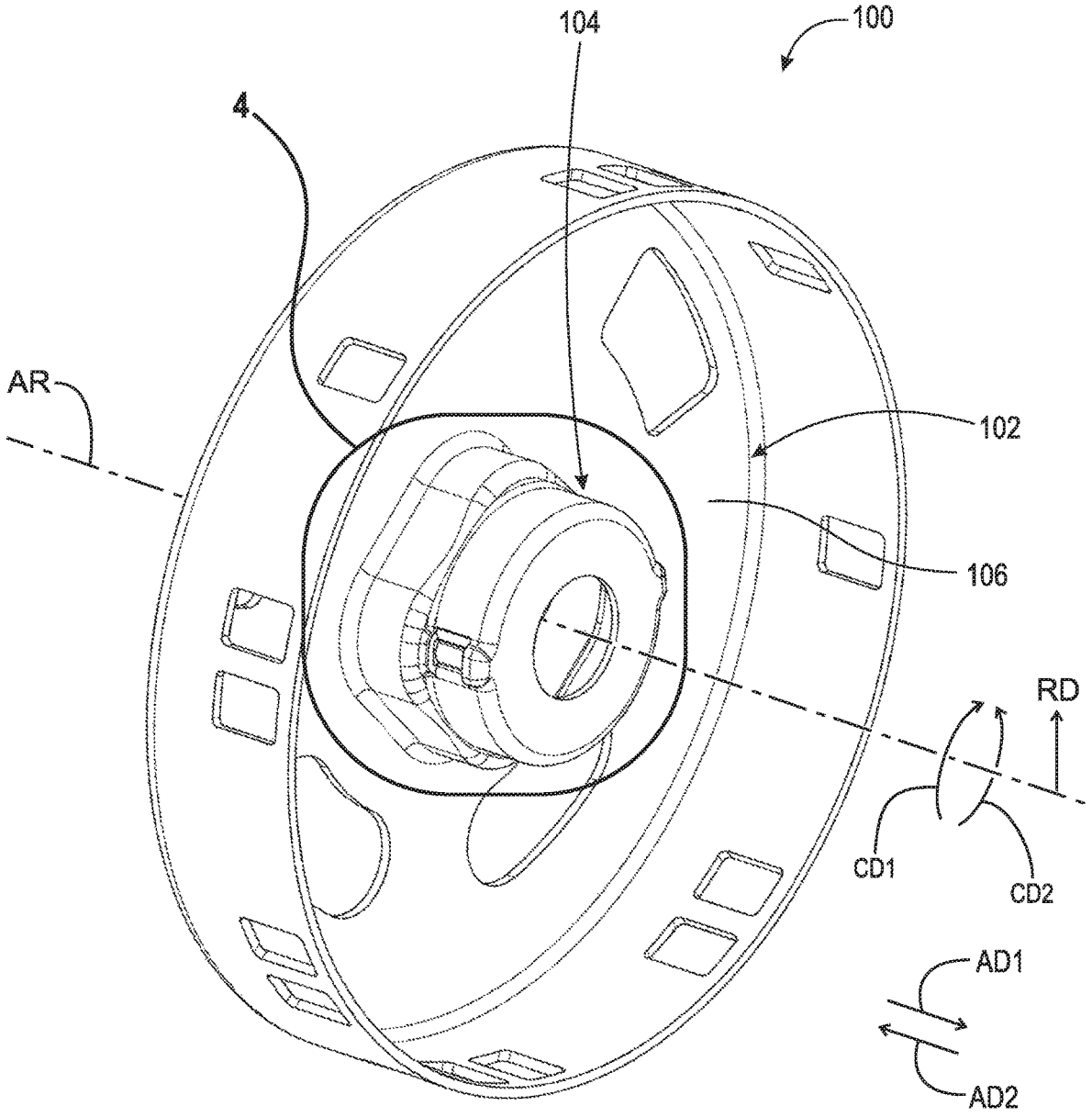
FIG. 2 is a front isometric view of the target wheel shown in FIG. 1.

FIG. 2 is a front isometric view of target wheel 100 shown in FIG. 1.

Figure 3:
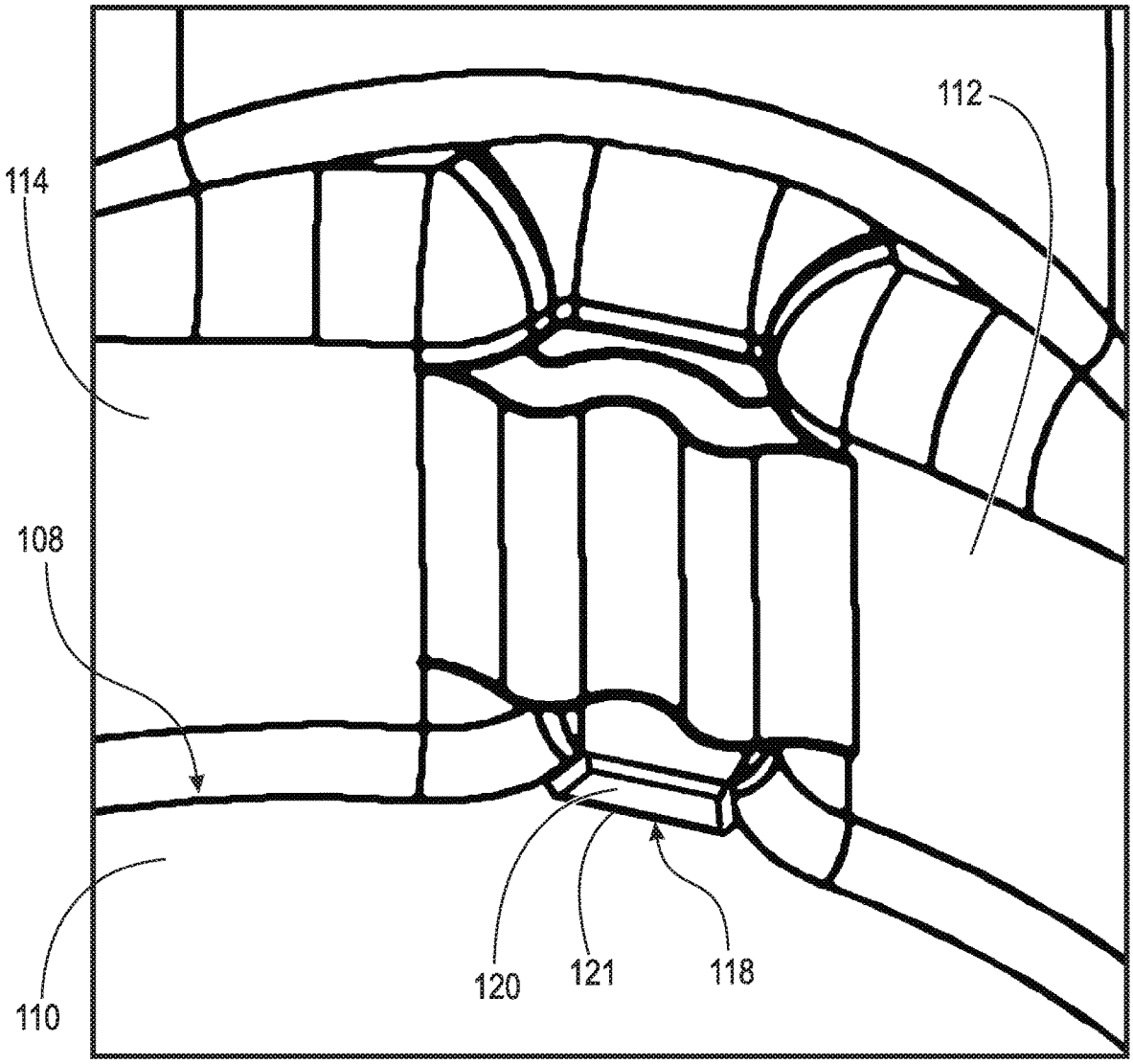
FIG. 3 is a detail of area 3 in FIG. 1.

FIG. 3 is a detail of a connection portion of target wheel 100 shown in FIG. 1.

Figure 4:
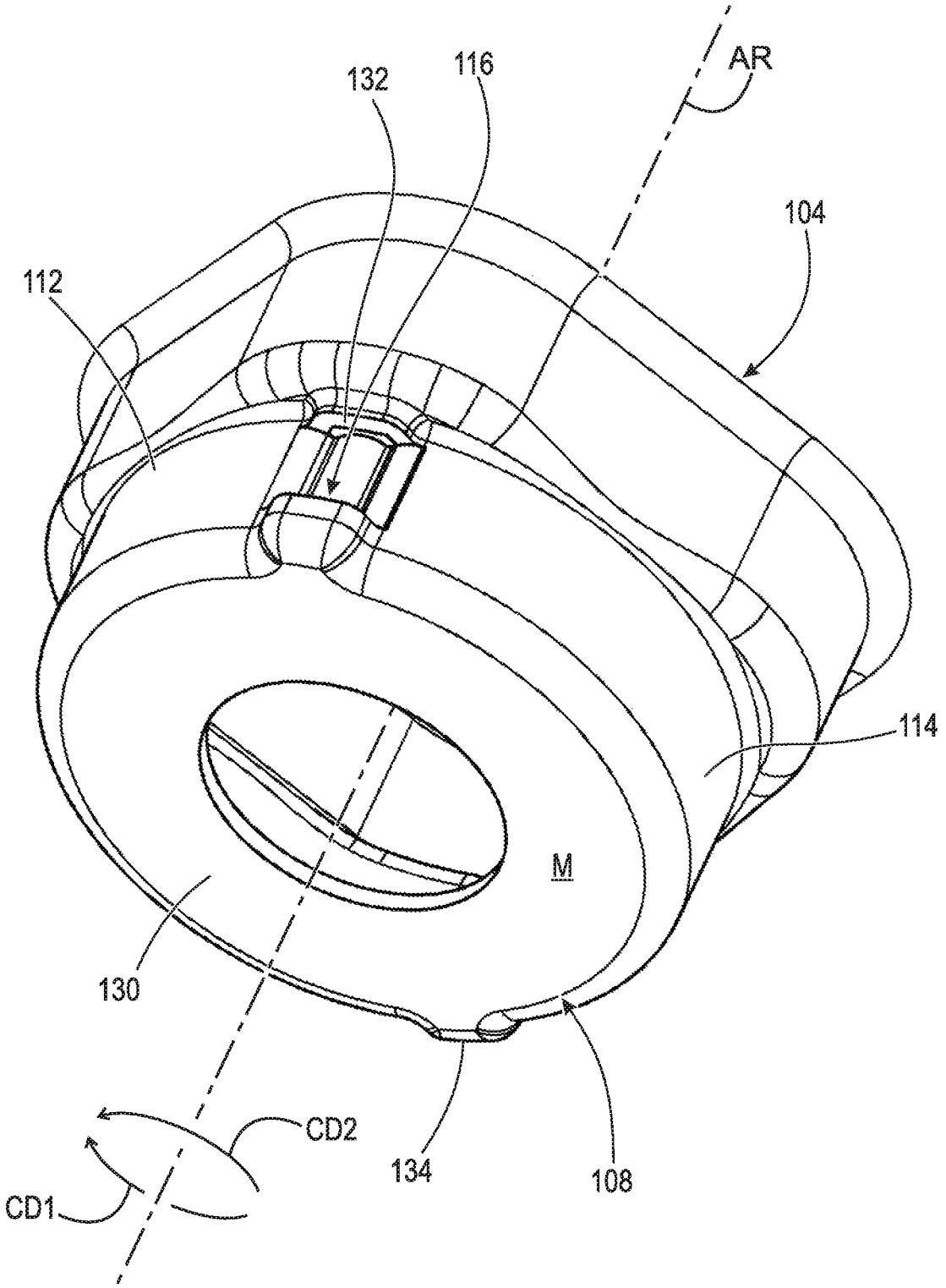
FIG. 4 is a detail of area 4 in FIG. 2.

FIG. 4 is a detail of area 4 in FIG. 2. The following should be viewed in light of FIGS. 1 through 4. Target wheel 100 for a camshaft phaser includes radially disposed wall 102 and connection portion 104. Wall 102 includes surface 106 facing in axial direction AD1. Direction AD1 is parallel to axis of rotation AR of target wheel 100. Connection portion 104 extends from surface 106 in axial direction AD1 and includes: wall 108 including surface 110 facing in axial direction AD2, opposite axial direction AD1; circumferentially disposed wall 112 connected to wall 108; circumferentially disposed wall 114 connected to wall 108; and tab 116. Tab 116 is directly connected to circumferentially disposed walls 112 and 114. Stated otherwise, tab 116 connected walls 112 and 114. Tab 116 extends radially outwardly past wall 112 and wall 114 in radially outward direction RD.

Target wheel 100 includes connected groove walls 118A through 118D. Groove walls 118A through 118D: extend from surface 110 into wall 108 in axial direction AD1; bound reinforcing groove, or indentation, 120 in wall 108; and form continuous edge 121 in surface 110. At least a portion of groove walls 118A through 118D is located between wall 112 and wall 114. In an example embodiment, an entirety of groove walls 118A through 118D is located between wall 112 and wall 114.

Figure 5:
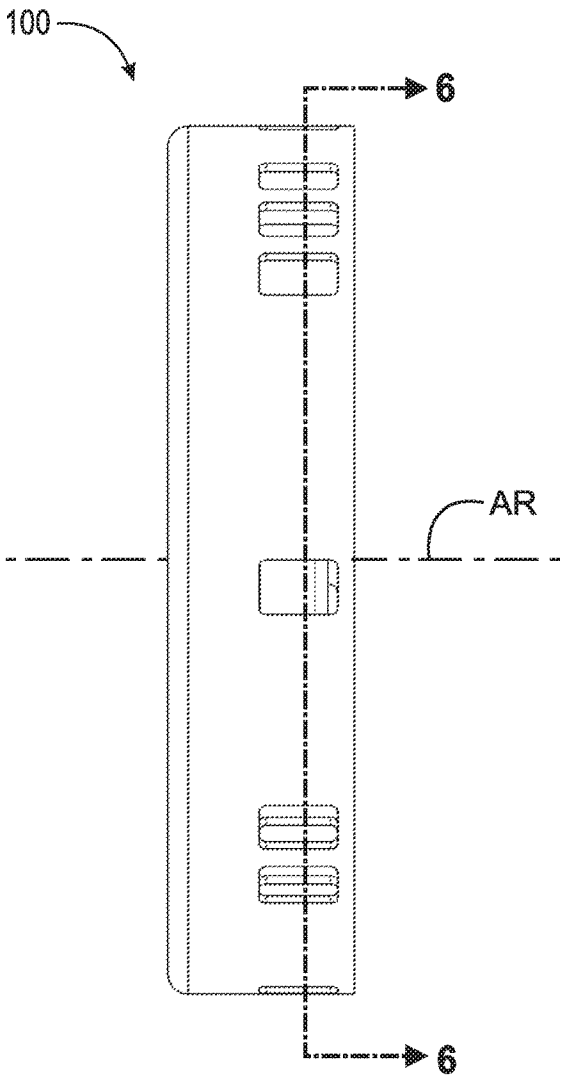
FIG. 5 is a side view of the target wheel shown in FIG. 1.

FIG. 5 is a side view of target wheel 100 shown in FIG. 1.

Figure 6:
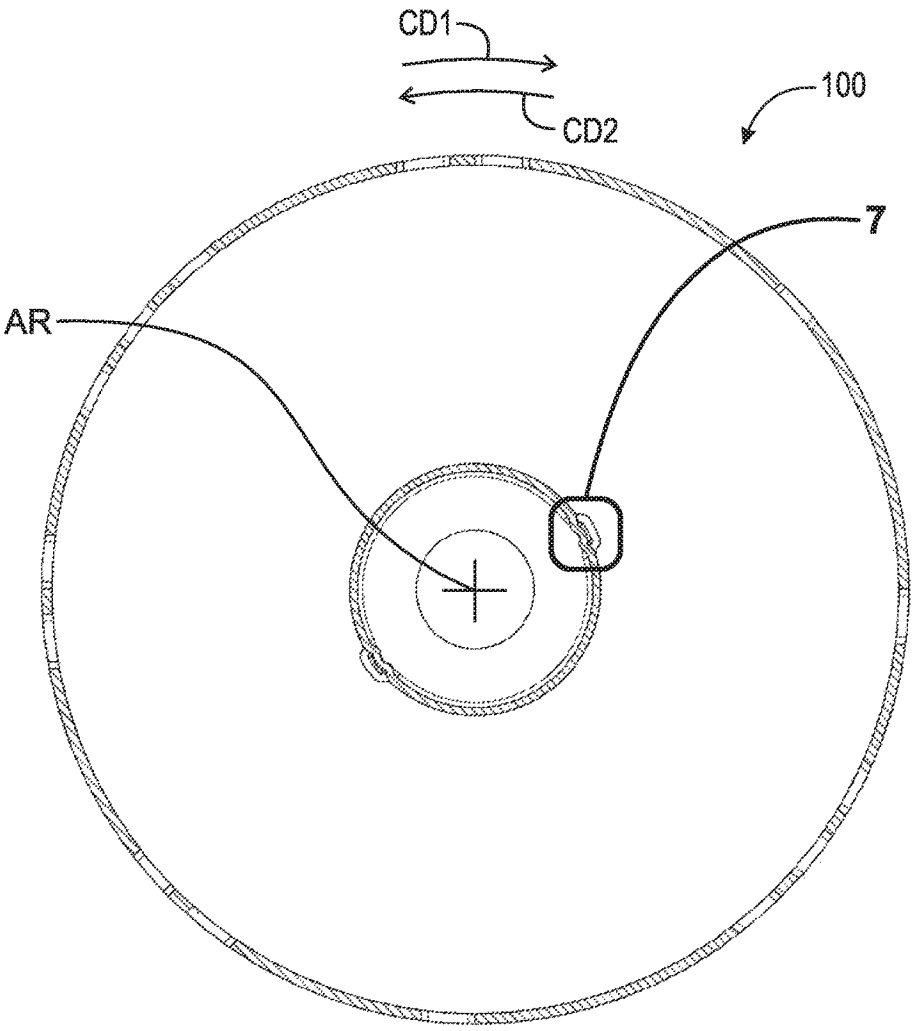
FIG. 6 is a cross-sectional view generally along line 6-6 in FIG. 5.

FIG. 6 is a cross-sectional view generally along line 6-6 in FIG. 5.

Figure 7:
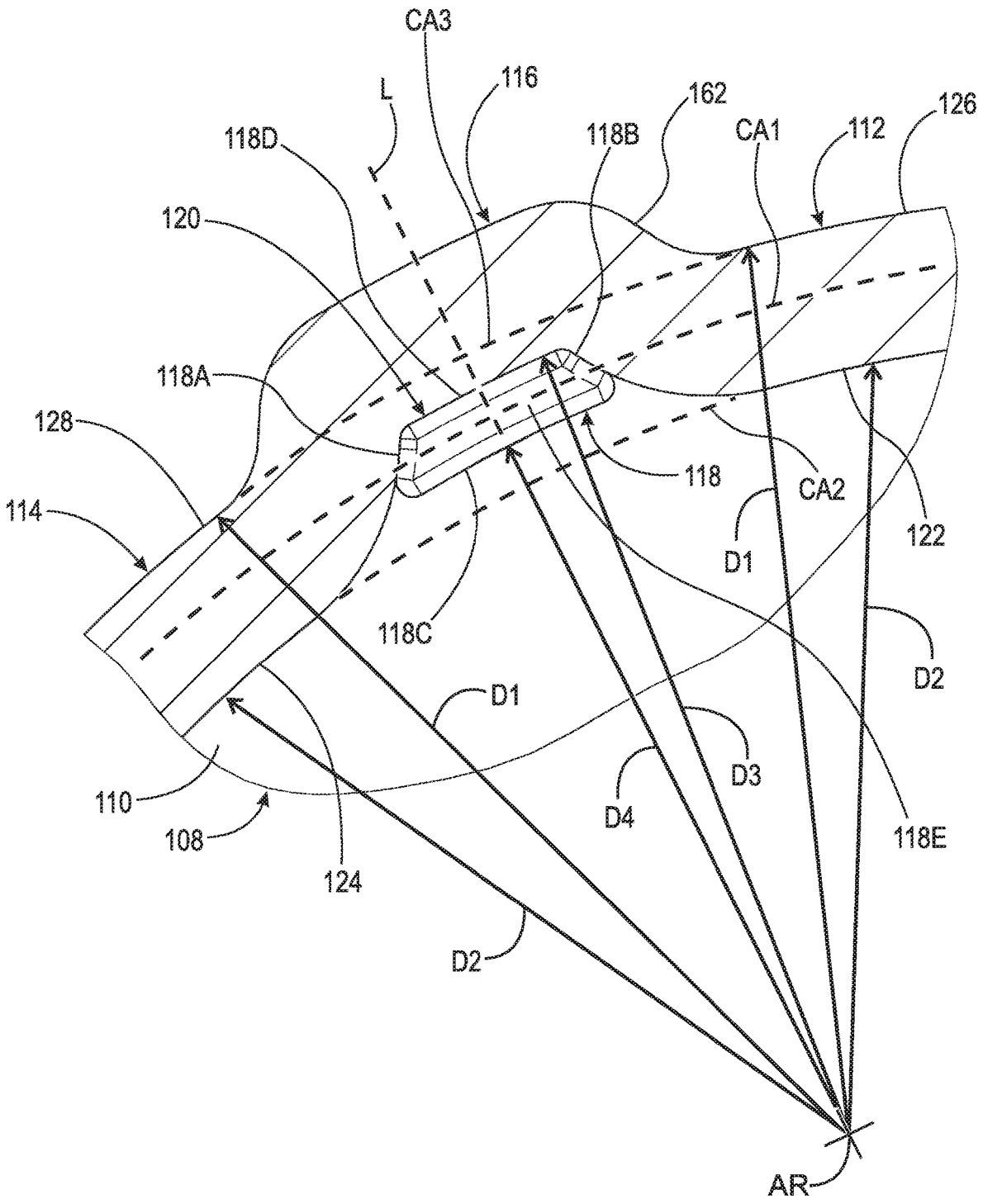
FIG. 7 is a detail of area 7 in FIG. 6.

FIG. 7 is a detail of area 7 in FIG. 6. The following should be viewed in light of FIGS. 1 through 7. Wall 114, at least a portion of groove walls 118A through 118D, and wall 112 are positioned in sequence in circumferential direction CD1. For example, using as a reference circular arc CA1, centered on axis of rotation AR: wall 112, groove wall 118B, reinforcing groove, or indentation 120, groove wall 118A and wall 114 are positioned in sequence in direction CD1. Groove walls 118A through 118D and tab 116 are sequentially aligned in radially outward direction RD. For example, using line L, extending from axis AR in radially outer direction RD, as a reference: wall 108, groove wall 118C, reinforcing groove 120, groove wall 118D, and tab 116 are sequentially aligned along line L in direction RD. In an example embodiment, no portion of groove walls 118A through 118D is aligned in sequence in radially outward direction RD with the wall 112 or wall 114.

Circumferentially disposed walls 112 and 114 includes surfaces 122 and 124, respectively, facing radially inwardly. At least a portion of groove walls 118A through 118D extend past surface 122 or 124 in radially outward direction RD. In an example embodiment, all of groove walls 118A through 118D and reinforcing groove 120 extend past surface 122 or surface 124 in direction RD. For example, using as a reference circular arc CA2, which is a circumferential continuation of surfaces 122 and 124, all of groove walls 118A through 118D extends past CA2 in direction RD. Stated otherwise: at least a portion of groove walls 118A through 118D is located radially outward of surface 122 or surface 124; and in an example embodiment, all of groove walls 118A through 118D and reinforcing groove 120 is located radially outward of surface 122 or surface 124.

Circumferentially disposed walls 112 and 114 includes surfaces 126 and 128, respectively, facing radially outwardly. At least a portion of groove walls 118A through 118D is located radially inward of surface 126 or surface 128; and in an example embodiment, all of groove walls 118A through 118D and reinforcing groove 120 is located radially inward of surface 126 or surface 128. For example, using as a reference circular arc CA3, which is a circumferential continuation of surfaces 126 and 128, all of groove walls 118A through 118D is radially inward of arc CA3.

Surfaces 122 and 124 are at distance D1 from axis of rotation AR (schematically positioned in FIG. 7) in direction RD. Surfaces 126 and 128 are at distance D2 from axis of rotation AR in direction RD. Distance D3 is a maximum distance, in direction RD, of groove walls 118A through 118D from axis AR. Distance D4 is a minimum distance, in direction RD, of groove walls 118A through 118D from axis AR. In an example embodiment, distance D3 is less than distance D1. In an example embodiment, distance D4 is greater than distance D2. In an example embodiment: distance D3 is less than distance D1; and distance D4 is greater than distance D2.

Figure 8:
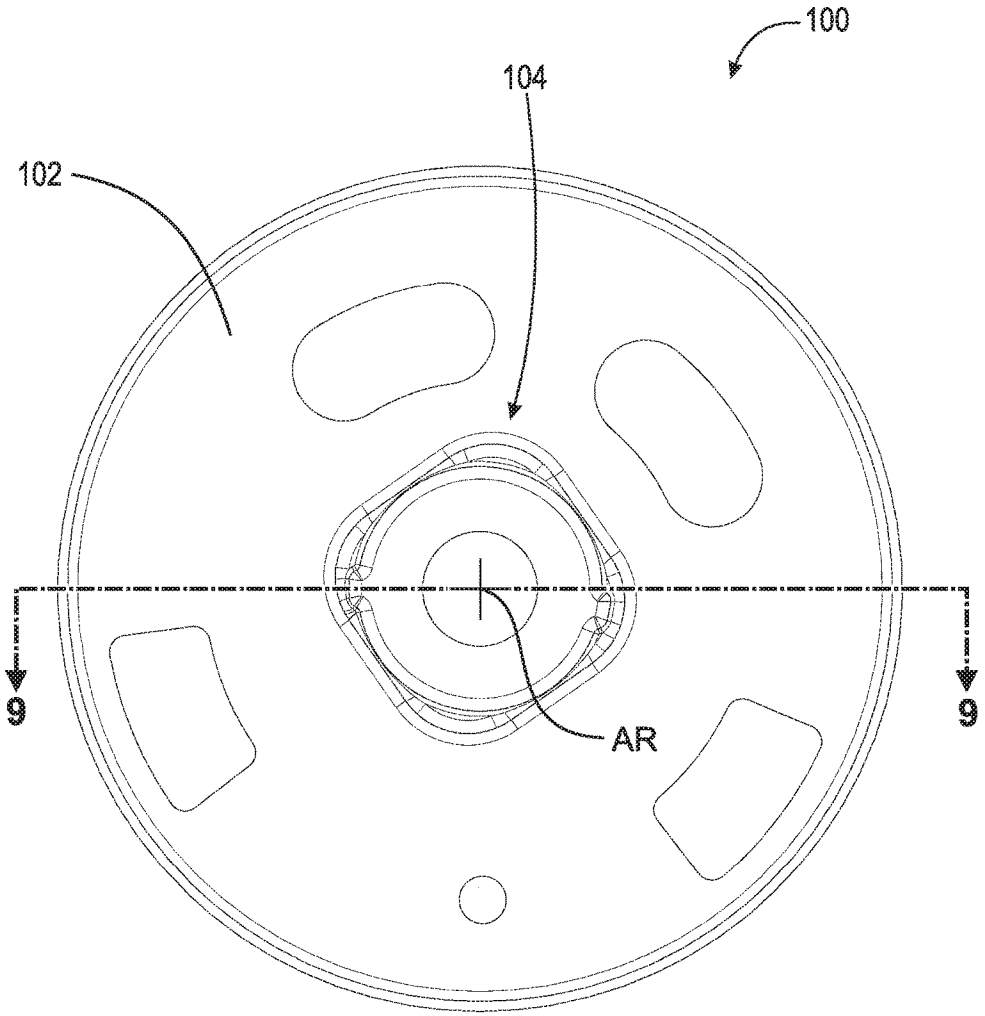
FIG. 8 is a front view of the target wheel shown in FIG. 1.

FIG. 8 is a front view of target wheel 100 shown in FIG. 1.

Figure 9:
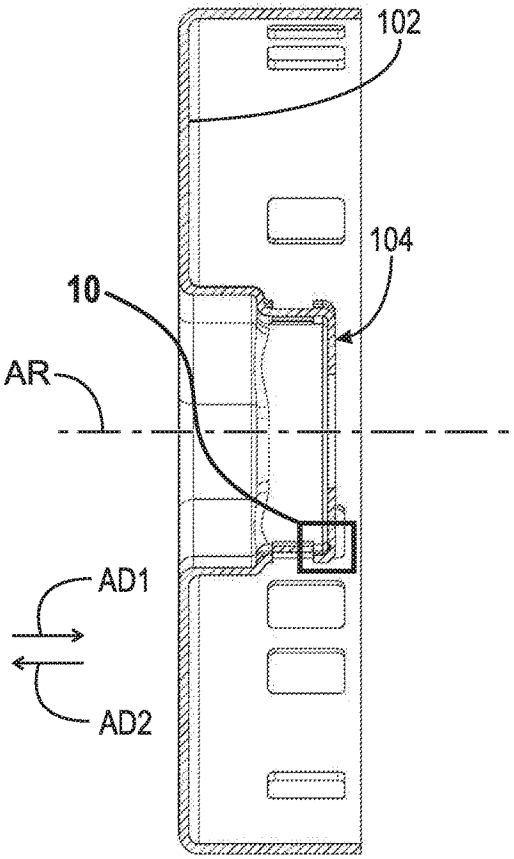
FIG. 9 is a cross-sectional view generally along line 9-9 in FIG. 8.

FIG. 9 is a cross-sectional view generally along line 9-9 in FIG. 8.

Figure 10:
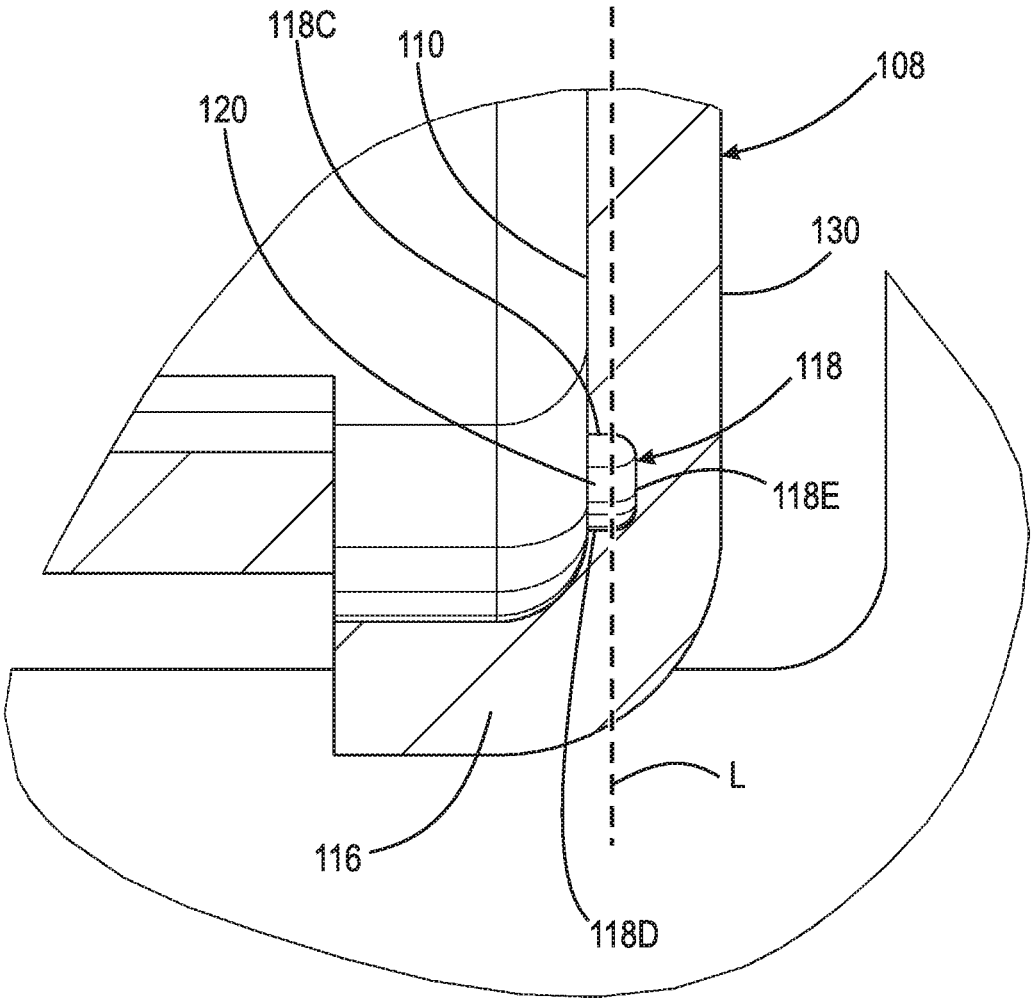
FIG. 10 is a detail of area 10 in FIG. 9.

FIG. 10 is a detail of area 10 in FIG. 9. The following should be viewed in light of FIGS. 1 through 10. Groove wall 118E faces in axial direction AD2 and bounds reinforcing groove 120 in direction AD1. That is, groove walls 118A through 118D not extend, or pass, completely through material M forming wall 108 to surface 130 of wall 108 facing in direction AD1. Surface 130 forms a segment of wall 108 extending furthest in axial direction AD1.

In an example embodiment, portion 104 includes tab 132: directly connected to walls 112 and 114, extending radially outwardly past walls 112 and 114; and axially offset from tab 116 in direction AD2. As further described further below, tabs 116 and 132 are arranged to axially bracket and grip a bias spring for a cam shaft phaser.

In an example embodiment, portion 104 includes tab 134 and groove walls and reinforcing groove (not shown) proximate tab 134 and in wall 108. The discussion for tab 116, groove walls 118A through 118E, and reinforcing groove 120 is applicable to tab 134 and the groove wall and reinforcing groove in wall 108.

The following should be viewed in light of FIGS. 1 through 10. The following describes a method of fabricating a target wheel for a camshaft phaser. Although the method is presented as a sequence of steps for clarity, no order should be inferred from the sequence unless explicitly stated. A first step forms a first wall of the target wheel. A second step extends a connection portion from the first wall in a first axial direction, the connection portion including a second wall with a first surface facing in a second axial direction opposite the first axial direction, a first circumferentially disposed wall connected to the second wall, a second circumferentially disposed wall connected to the second wall, and a tab directly connected to the first circumferentially disposed wall and the second circumferentially disposed wall and extending radially outwardly past the first circumferentially disposed wall. A third step forms an indentation in the first surface. A fourth step displaces material forming the second wall radially outwardly from the indentation. a fifth step bounds the indentation with a plurality of connected groove walls in the second wall. A sixth step locates the plurality of connected groove walls and the tab in sequence in a radially outward direction. A seventh step locates the plurality of connected groove walls between the first circumferentially disposed wall and the second circumferentially disposed wall.

In an example embodiment, the second step includes forming a second surface of the first circumferentially disposed wall facing radially inwardly, and locating at least a portion of the groove wall radially outward of the second surface, or locating an entirety of the groove wall radially outward of the second surface. In an example embodiment, the second step includes forming a second surface of the first circumferentially disposed wall facing radially outwardly, and locating at least a portion of the groove wall radially inward of the second surface, or locating an entirety of the groove wall radially inward of the second surface.

Tab 116 and reinforcing groove, or indentation, 120 address the problem noted above of damage to target wheel tabs during assembly of a camshaft phaser including the target wheel or by rough handling of the camshaft phaser after installation of a bias spring. Forming reinforcing groove 120 displaces material M away from reinforcing groove and toward tab 116 increasing the thickness of material M in portions of tab 116, which in turn increases the strength, durability, and service life of target wheel 100.

Figure 11:
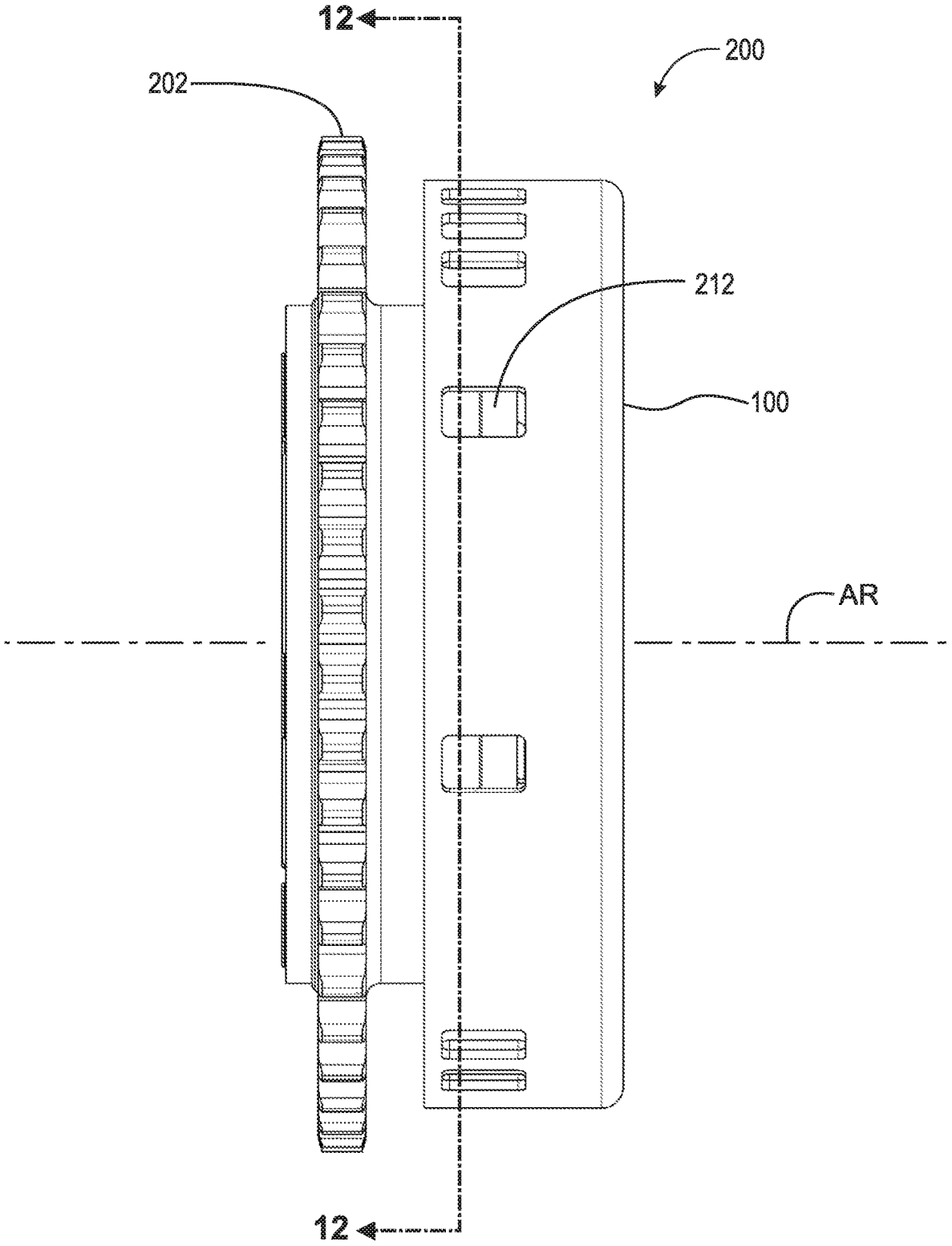
FIG. 11 is a side view of a cam shaft phaser with the target wheel shown in FIG. 1.

FIG. 11 is a side view of cam shaft phaser 200 with target wheel 100 shown in FIG. 1.

Figure 12:
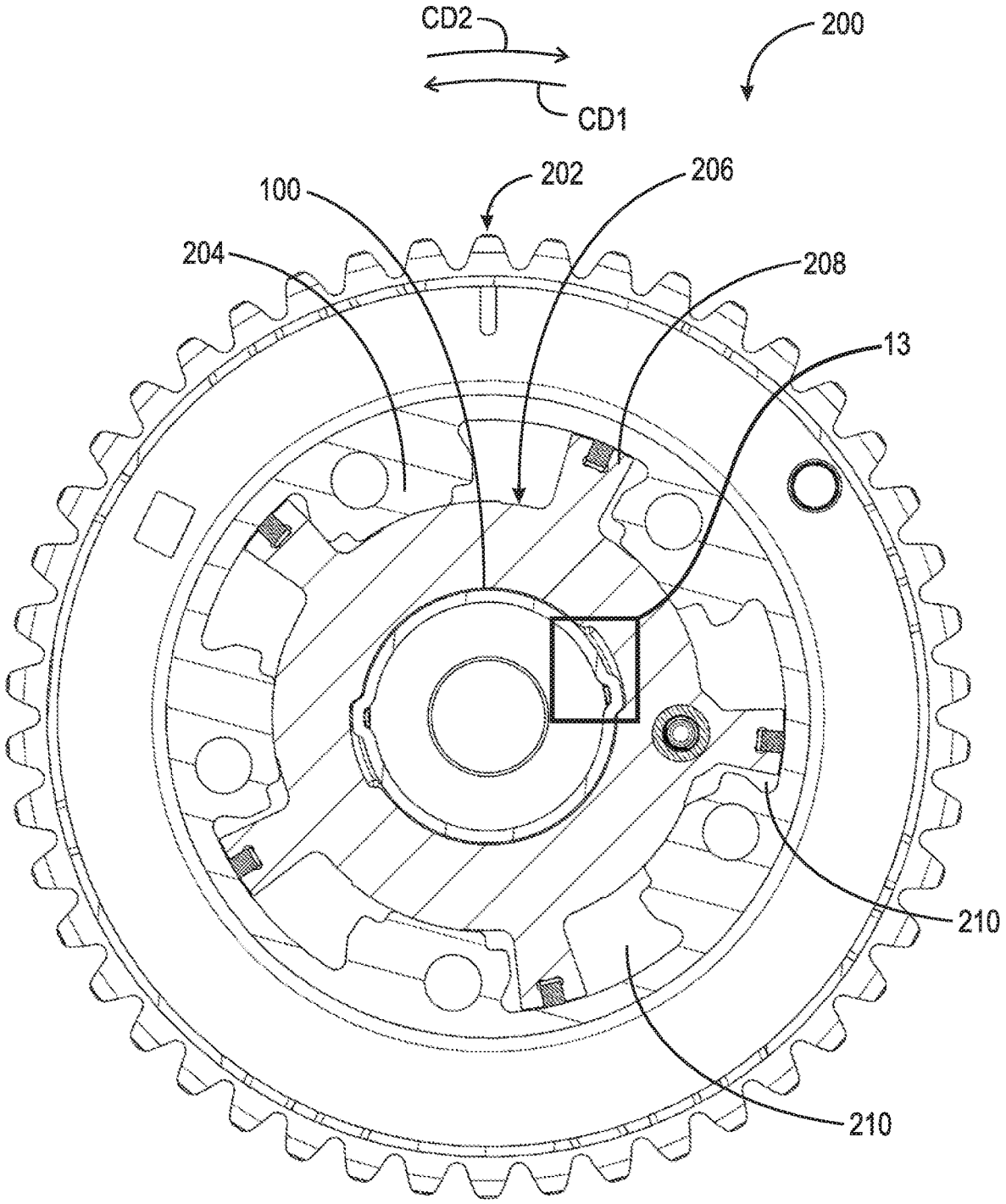
FIG. 12 is a cross-sectional view generally along line 11-11 in FIG. 10.

FIG. 12 is a cross-sectional view generally along line 11-11 in FIG. 10.

Figure 13:
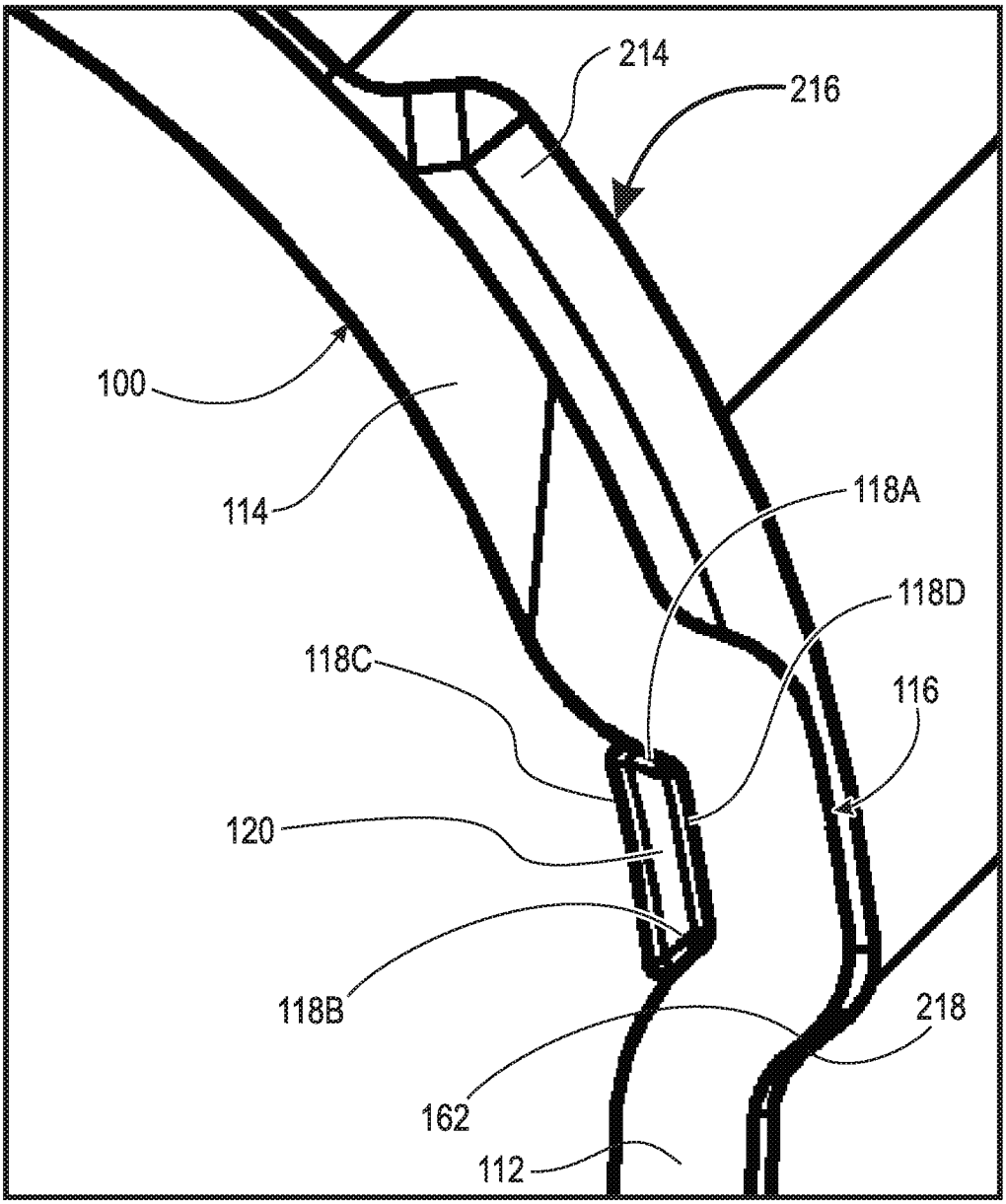
FIG. 13 is a detail of area 13 in FIG. 12.

FIG. 13 is a detail of area 13 in FIG. 12. The following should be viewed in light of FIGS. 1 through 13. Camshaft phaser 200 includes: stator 202 arranged to receive rotational torque and including radially inwardly extending protrusions 204; rotor 206 including radially outwardly extending protrusions 208 circumferentially interleaved with radially inwardly extending protrusions 204; phaser chambers 210; bias spring 212 connected to rotor 206; and target wheel 100. Each phaser chamber 210 is circumferentially bounded by: a respective radially inwardly extending protrusion 204; and a respective radially outwardly extending protrusion 208. Tab 116 and tab 132 axially bracket spring 212, grip spring 212, and are fixed to spring 212.

Rotor 206 includes indentation 214 bounded by indentation wall 216 in directions RD1, CD1, and CD2. Portion 218 of wall 216 bounds indentation 214 in direction CD2. Tab 116 is disposed in indentation 214 and bias spring 212 urges tab 116 in direction CD2 and into contact with portion 218 of wall 216, resulting in contact between portion 218 and tab 116.

Figure 14:
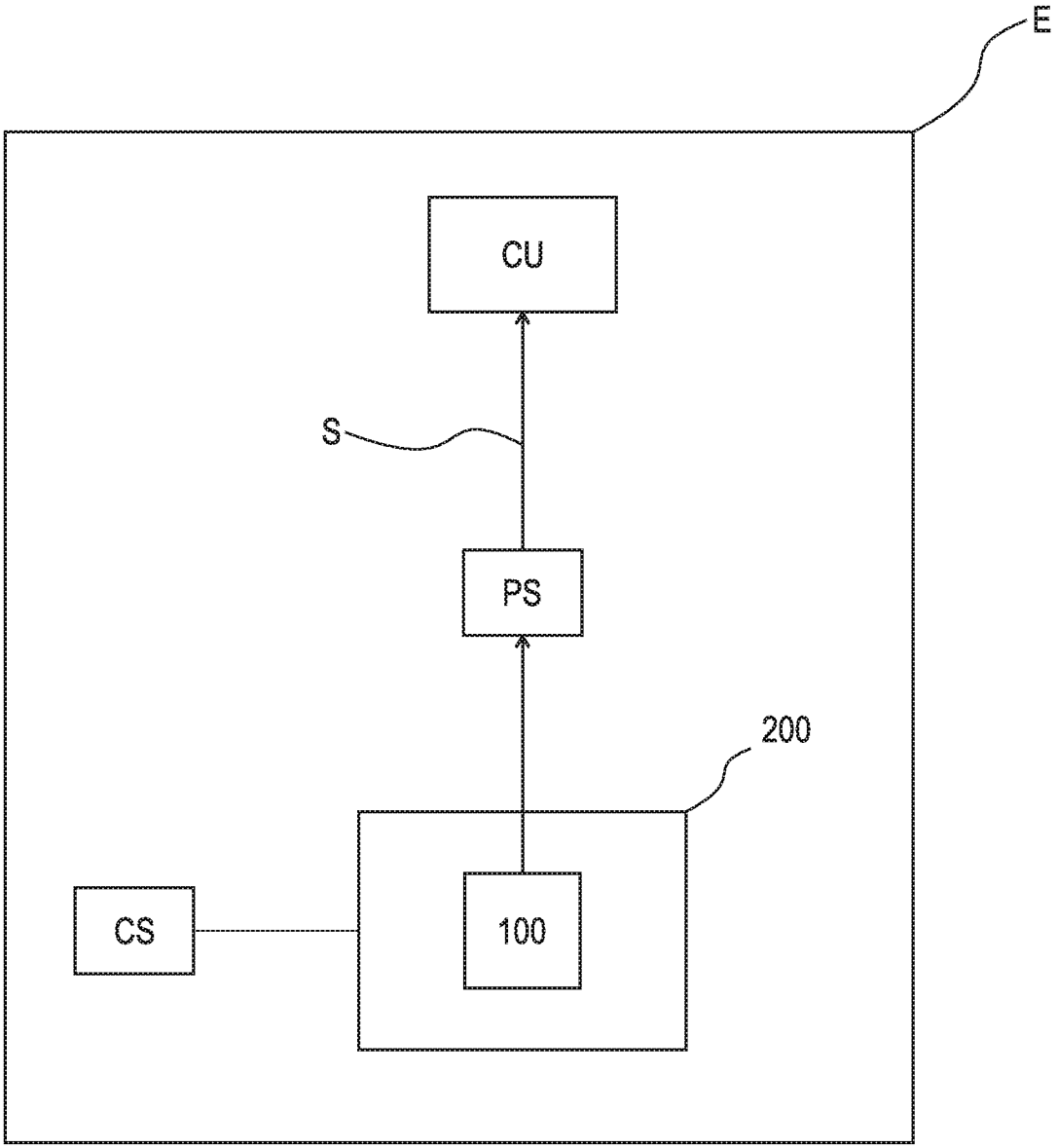
FIG. 14 is a schematic block diagram with the camshaft phaser, shown in FIG. 11.

FIG. 14 a schematic block diagram including camshaft phaser 200 shown in FIG. 11. As is known in the art, target wheel 100 is arranged to interface with position sensor PS to detect a rotational, or circumferential, position of target wheel 100, and through the rotational position of target wheel 100, respective rotational, or circumferential positions of rotor 206 and camshaft CS, non-rotatably connected to rotor 206. For example, sensor PS sends signal S, including the rotational, or circumferential, position of target wheel 100, to control unit CU for engine E including camshaft phaser CS. Control unit CU uses signal S and other data to control or change phasing of camshaft CS.—

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE CHARACTERS

AD1 axial direction
AD2 axial direction
CA1 circular arc
CA2 circular arc
CA3 circular arc
CS camshaft
CU control unit
D1 radial distance
D2 radial distance
D3 radial distance
D4 radial distance
E engine
L line
M material, wall 108
PS position sensor
RD radially outward direction
S signal
100 target wheel
102 radially disposed wall
104 connection portion
106 surface, wall 102
108 wall, connection portion
110 surface, wall 108
112 circumferentially disposed wall
114 circumferentially disposed wall
116 tab
118A groove wall
118B groove wall
118C groove wall
118D groove wall
118E groove wall
120 reinforcing groove or indentation
122 surface, wall 112
124 surface, wall 114
126 surface, wall 112
128 surface, wall 114
130 surface, wall 108
132 tab
134 tab
200 camshaft phaser

202 stator
204 protrusion, stator
206 rotor
208 protrusion, rotor
210 phase chamber
212 bias spring
214 indentation, rotor
216 indentation wall
218 portion, wall 216

The invention claimed is:

1. A target wheel for a camshaft phaser, comprising:

a first surface facing in a first axial direction, parallel to an axis of rotation of the target wheel; and, a connection portion extending from the first surface in the first axial direction and including a wall with a second surface facing in a second axial direction opposite the first axial direction, a first circumferentially disposed wall connected to the wall, a second circumferentially disposed wall connected to the wall, a first tab directly connected to the first circumferentially disposed wall and the second circumferentially disposed wall and extending radially outwardly past the first circumferentially disposed wall and the second circumferentially disposed wall, and a plurality of connected groove walls extending from the second surface into the wall in the first axial direction and bounding a reinforcing groove in the wall, wherein at least a portion of the plurality of connected groove walls is located between the first circumferentially disposed wall and the second circumferentially disposed wall.

2. The target wheel of claim 1, wherein the first circumferentially disposed wall, a first groove wall included in the plurality of connected groove walls, the reinforcing groove, a second groove wall included in the plurality of connected groove walls, and the second circumferentially disposed wall are positioned in sequence in a circumferential direction.

3. The target wheel of claim 1, wherein the plurality of connected groove walls and the first tab are sequentially aligned in a radially outward direction.

4. The target wheel of claim 1, wherein the wall includes a second surface facing in the first axial direction, and the second surface forms a segment of the connection portion extending furthest in the first axial direction.

5. The target wheel of claim 1, wherein the wall, a first groove wall included in the plurality of connected groove walls, the reinforcing groove, a second groove wall included in the plurality of connected groove walls, and the first tab are positioned in sequence in a radially outward direction.

6. The target wheel of claim 1, wherein the first circumferentially disposed wall includes a third surface facing radially inwardly, and at least a portion of the plurality of connected groove walls is located radially outward of the third surface.

7. The target wheel of claim 6, wherein an entirety of the plurality of connected groove walls is located radially outward of the third surface.

8. The target wheel of claim 1, wherein the first circumferentially disposed wall includes a third surface facing radially outwardly, and at least a portion of the plurality of connected groove walls is located radially inward of the third surface.

9. The target wheel of claim 8, wherein an entirety of the plurality of connected groove walls is located radially inward of the third surface.

10. The target wheel of claim 1, wherein the first circumferentially disposed wall includes a third surface facing radially outwardly and at a first distance, in a radially outer direction, from an axis of rotation of the target wheel; and wherein a maximum distance, in the radially outer direction, of the plurality of connected groove walls from the axis of rotation of the target wheel is less than the first distance.

11. The target wheel of claim 1, wherein the first circumferentially disposed wall includes a third surface facing radially inwardly and at a first distance, in a radially outer direction, from an axis of rotation of the target wheel; and wherein a minimum distance, in the radially outer direction, of the plurality of connected groove walls from the axis of rotation of the target wheel is greater than the first distance.

12. The target wheel of claim 1, wherein no portion of the plurality of connected groove walls is aligned in sequence in a radially outward direction with the first circumferentially disposed wall or the second circumferentially disposed wall.

13. The target wheel of claim 1, wherein the plurality of connected groove walls does not pass completely through a material forming the wall.

14. The target wheel of claim 1, wherein the connection portion includes a second tab directly connected to the first circumferentially disposed wall and to the second circumferentially disposed wall; wherein the second tab extends radially outwardly past the first circumferentially disposed wall and the second circumferentially disposed wall; and wherein the second tab is offset from the first tab in the second axial direction.

15. A camshaft phaser, comprising:

an axis of rotation;

a stator arranged to receive rotational torque and including a plurality of radially inwardly extending protrusions;

a rotor including a first wall, an indentation wall bounding an indentation in the first wall, and a plurality of radially outwardly extending protrusions circumferentially interleaved with the plurality of radially inwardly extending protrusions;

a plurality of phaser chambers, each phaser chamber circumferentially bounded by a respective radially inwardly extending protrusion included in the plurality of radially inwardly extending protrusions and a respective radially outwardly extending protrusion included in the plurality of radially outwardly extending protrusions; and, a target wheel including a first surface facing in a first axial direction, parallel to an axis of rotation of the target wheel, and a connection portion extending from the first surface in the first axial direction, wherein the connection portion includes a wall with a second surface facing in a second axial direction opposite the first axial direction, a first circumferentially disposed wall connected to the second surface, a second circumferentially disposed wall connected to the second surface, a tab directly connected to the first circumferentially disposed wall and the second circumferentially disposed wall and extending radially outwardly past the first circumferentially disposed wall, and a plurality of connected groove walls; wherein the plurality of connected groove walls extend from the second surface into the wall in the first axial direction and bound a reinforcing groove in the wall; wherein at least a portion of the plurality of connected groove walls is located between the first circumferentially disposed wall and the second circumferentially disposed wall; wherein at least a portion of the tab is located in the indentation of the rotor; and wherein the target wheel is arranged to detect a circumferential position of the rotor for use in rotating the rotor, with respect to the stator, to change a phase of a camshaft connected to the rotor.

16. A method of fabricating a target wheel for a camshaft phaser, comprising:

forming a first wall of the target wheel;

extending a connection portion from the first wall in a first axial direction, the connection portion including a second wall with a first surface facing in a second axial direction opposite the first axial direction, a first circumferentially disposed wall connected to the second wall, a second circumferentially disposed wall connected to the second wall, and a tab directly connected to the first circumferentially disposed wall and the second circumferentially disposed wall and extending radially outwardly past the first circumferentially disposed wall;

forming an indentation in the first surface;

displacing material forming the second wall radially outwardly from the indentation;

bounding the indentation with a plurality of connected groove walls in the second wall;

locating the plurality of connected groove walls and the tab in sequence in a radially outward direction; and, locating the plurality of connected groove walls between the first circumferentially disposed wall and the second circumferentially disposed wall.

17. The method of claim 16, wherein extending a connection portion from the first wall in the first axial direction includes forming a second surface of the first circumferentially disposed wall facing radially inwardly, and locating at least a portion of the plurality of connected groove walls radially outward of the second surface, or locating an entirety of the plurality of connected groove walls radially outward of the second surface.

18. The method of claim 16, wherein extending a connection portion from the first wall in the first axial direction includes forming a second surface of the first circumferentially disposed wall facing radially outwardly, and locating at least a portion of the plurality of connected groove walls radially inward of the second surface, or locating an entirety of the plurality of connected groove walls radially inward of the second surface.

19. The camshaft phaser of claim 15, wherein the plurality of connected groove walls and the tab are sequentially aligned in a radially outward direction.

20. The camshaft phaser of claim 19, further comprising:

a bias spring arranged to urge the target wheel in a circumferential direction and to urge the tab into contact with the indentation wall.

* * * * *